US010524041B1

(12) United States Patent
Lin

(10) Patent No.: US 10,524,041 B1
(45) Date of Patent: Dec. 31, 2019

(54) HEADPHONE DRIVER AND DRIVING METHOD THEREOF

(71) Applicant: MACRONIX International Co., Ltd., Hsinchu (TW)

(72) Inventor: Hsiao-Ming Lin, Taoyuan (TW)

(73) Assignee: MACRONIX International Co., Ltd., Hsinchu (TW)

( * ) Notice: Subject to any disclaimer, the term of this patent is extended or adjusted under 35 U.S.C. 154(b) by 0 days.

(21) Appl. No.: 16/384,569

(22) Filed: Apr. 15, 2019

(51) Int. Cl.
*H04R 1/10* (2006.01)
*H04R 3/02* (2006.01)

(52) U.S. Cl.
CPC ..... *H04R 1/1083* (2013.01)

(58) Field of Classification Search
CPC ..... H04R 1/1083
See application file for complete search history.

(56) References Cited

U.S. PATENT DOCUMENTS 7,009,549 B1 * 3/2006 Corsi ..... H03M 1/08 341/118
8,878,587 B1 * 11/2014 Steensgaard-Madsen ..... G05F 3/02 327/306
2007/0285166 A1 * 12/2007 Shia ..... G11C 7/062 330/258
2015/0249434 A1 * 9/2015 Ogawa ..... G01P 3/487 73/504.02
2016/0079941 A1 * 3/2016 Zhong ..... H03F 3/387 330/9

* cited by examiner

*Primary Examiner* — Simon King
(74) *Attorney, Agent, or Firm* — J.C. Patents

(57) ABSTRACT

A headphone driver includes first and second differential driver differential driver. The first differential driver has a first positive output terminal and a first negative output terminal. The first positive output terminal is coupled to a first terminal of a first speaker. The first negative output terminal is virtually shorted to a reference voltage through a first feedback circuit in the first differential driver. The second differential driver has a second positive output terminal and a second negative output terminal. The second positive output terminal is coupled to a first terminal of a second speaker, wherein the second negative output terminal is virtually shorted to the reference voltage through a second feedback circuit in the first differential driver. The first negative terminal and the second negative terminal are connected to a common line, which is to be further connected to second terminals of the first speaker and the second speaker.

18 Claims, 3 Drawing Sheets

HEADPHONE DRIVER AND DRIVING METHOD THEREOF

BACKGROUND

Field of the Disclosure

The present disclosure relates to a headphone driving technique, and more particularly to a headphone driving technique that can effectively eliminate pop-noise.

Description of Related Art

Headphones are common electronic products to provide actual sound to users, and headphones that can produce stereo sound are even more popular.

As generally known, stereo headphone contains two speakers corresponding to two channels. A speaker typically includes a first terminal and a second terminal. The first terminal receives electrical audio signal and its waveform changes with the sound. The second terminal is a grounded terminal, which corresponds to the electrical audio signal at the first terminal and an alternating current signal between the first terminal and the second terminal is formed, according to its frequency and amplitude, so as to cause the diaphragm of the speaker to vibrate. In this manner, both the second terminals of the two speakers of the headphone are connected together, and both the first terminals of the two speakers respectively receive the audio signals of two channels. Therefore, the receiving terminals of the stereo headphone is a three-terminal structure.

The sound to be presented by the headphone is provided by a driver. As is typically known, the three-terminal plug of the headphone is inserted into the output hole of the electronic product. The headphone driver provides an electrical signal through the three terminals of the output hole to drive the speaker in order to convert the signal into an actual sound.

The two speakers are provided with the sounds in different channels respectively by two drivers. To one driver which converts the sound of the corresponding channel into electrical signal, the electrical signal is then output from its output terminal. Another driver is also converting the sound of the corresponding channel into electrical signal and then outputs the electrical signal from its output terminal.

The electrical signal is an alternating current (AC) form and the driver in an example is biased to a direct current (DC) voltage level of the AC signal. As a result, a direct current (DC) current would flow through the headphone. To avoid this DC current, a capacitor is implemented between the driver and the headphone as to be connected, so as to exclude the DC current. Further, if the output voltage level of the driver in operation is suddenly changed as undesired, an undesired AC current would be induced, which causes a pop-noise while the current flows through the headphone.

In addition, if the driver provides an electrical audio signal formed between a positive voltage and a negative voltage, it is also necessary to increase the circuit to produce negative voltage, which causes the cost to be increased.

It is one of the factors needs to be considered in the research and development of driving technique to find out how to drive the headphone more effectively while the occurrence of pop-noise may be avoided.

SUMMARY

The disclosure provides a headphone driver and a driving method thereof, which can maintain the differential output mode for driving a three-terminal headphone, in which the capability to resist the interference is higher than that of the driving manner by single-ended output terminal and the phenomenon of pop-noise can also be effectively avoided.

In one embodiment, the present disclosure provides a headphone driver. The headphone driver is adapted to drive a first speaker and a second speaker. The headphone driver includes a first differential driver and a second differential driver. The first differential driver has a first positive output terminal and a first negative output terminal. The first positive output terminal is connected to a first terminal of the first speaker, wherein the first negative output terminal is virtually shorted to a reference voltage through a first feedback circuit in the first differential driver. The second differential driver has a second positive output terminal and a second negative output terminal. The second positive output terminal is connected to a first terminal of the second speaker, wherein the second negative output terminal is virtually shorted to the reference voltage through a second feedback circuit in the second differential driver. The first negative output terminal and the second negative output terminal are connected to a common line. The common line is to be further connected to second terminals of the first speaker and the second speaker.

In one embodiment, as to the headphone driver described above, the first differential driver includes: a fully differential amplifier that receives an input signal and provides the first positive output terminal and the first negative output terminal; and an operational amplifier as the first feedback circuit, wherein a first input terminal of the operational amplifier is connected to the reference voltage, and the second input terminal of the operational amplifier is connected to the first negative output terminal. An output terminal of the operational amplifier is fed back to a feedback signal input terminal of the fully differential amplifier.

In one embodiment, as to the headphone driver described above, the second differential driver includes: a fully differential amplifier that receives an input signal and provides the second positive output terminal and the second negative output terminal; and an operational amplifier as the second feedback circuit, wherein a first input terminal of the operational amplifier is connected to the reference voltage, and a second input terminal of the operational amplifier is connected to the second negative output terminal. The output terminal of the operational amplifier is fed back to a feedback signal input terminal of the fully differential amplifier.

In one embodiment, as to the headphone driver described above, an input port of the first differential driver is differential input terminals.

In one embodiment, as to the headphone driver described above, the input port of the first differential driver is a single-ended input terminal.

In one embodiment, as to the headphone driver described above, an input port of the second differential driver is differential input terminals.

In one embodiment, as to the headphone driver described above, the input port of the second differential driver is a single-ended input terminal.

In one embodiment, as to the headphone driver described above, the reference voltage is set at a direct-current voltage level of an electrical audio alternating-current (AC) signal.

In one embodiment, the present disclosure further provides a headphone driving method for driving a first speaker and a second speaker. The headphone driving method includes using a first differential driver for receiving a first input signal and outputting a first driving signal through first differential output terminals including a first positive output terminal and a first negative output terminal, wherein the first positive output terminal is connected to a first terminal of the first speaker. The first negative output terminal is virtually shorted to a reference voltage through a first feedback circuit in the first differential driver. The second differential driver is used to receive a second input signal and output a second driving signal through second differential output terminals including a second positive output terminal and a second negative output terminal. The second positive output terminal is connected to a first terminal of the second speaker. The second negative output terminal is virtually shorted to the reference voltage through a second feedback circuit in the second differential driver. The first negative output terminal and the second negative output terminal are connected to a common line. The common line is to be further connected to second terminals of the first speaker and the second speaker.

In one embodiment, as to the headphone driving method described above, the first differential driver used in the method includes: a fully differential amplifier configured to receive the first input signal, and provide the first positive output terminal and the first negative output terminal; and an operational amplifier used as the first feedback circuit, wherein a first input terminal of the operational amplifier is connected to the reference voltage, and a second input terminal of the operational amplifier is connected to the first negative output terminal. An output terminal of the operational amplifier is fed back to a feedback signal input terminal of the fully differential amplifier.

In one embodiment, as to the headphone driving method described above, the second differential driver used in the method includes: a fully differential amplifier configured to receive the second input signal, and provide the second positive output terminal and the second negative output terminal; and an operational amplifier used as the second feedback circuit, wherein a first input terminal of the operational amplifier is connected to the reference voltage, and a second input terminal of the operational amplifier is connected to the second negative output terminal. An output terminal of the operational amplifier is fed back to a feedback signal input terminal of the fully differential amplifier.

In one embodiment, as to the headphone driving method described above, an input port of the first differential driver is differential input terminals for receiving the first input signal.

In one embodiment, as to the headphone driving method described above, an input port of the first differential driver is a single-ended input terminal for receiving the first input signal.

In one embodiment, as to the headphone driving method described above, an input port of the second differential driver is differential input terminals for receiving the second input signal.

In one embodiment, in the headphone driving method described above, an input port of the second differential driver is a single-ended input terminal for receiving the second input signal.

In one embodiment, in the headphone driving method described above, the reference voltage is set at a direct-current voltage level of an electrical audio alternating-current (AC) signal.

In one embodiment, the present disclosure further provides a headphone driver for driving a speaker, including a differential driver having a positive output terminal and a negative output terminal. The positive output terminal is connected to the first terminal the speaker, wherein the negative output terminal is virtually shorted to a reference voltage through a feedback circuit in the differential driver. The negative output terminal is connected to a line. The line is to be further connected to a second terminal of the speaker.

In one embodiment, in the headphone driver described above, the differential driver includes: a fully differential amplifier that receives an input signal and provides the positive output terminal and the negative output terminal; and an operational amplifier as the feedback circuit. A first input terminal of the operational amplifier is connected to the reference voltage, and a second input terminal of the operational amplifier is connected to the first negative output terminal of the fully differential amplifier. An output terminal of the operational amplifier is fed back to the fully differential amplifier.

In order to make the aforementioned features and advantages of the disclosure more comprehensible, embodiments accompanying figures are described in detail below.

DESCRIPTION OF EMBODIMENTS

The disclosure relates to a headphone driver and a driving method thereof, which can maintain the output mode of the driver for a three-terminal speaker while effectively avoiding the phenomenon of pop-noise. Multiple embodiments are provided to illustrate the disclosure, but the disclosure is not limited to the embodiments as provided.

Figure 1:
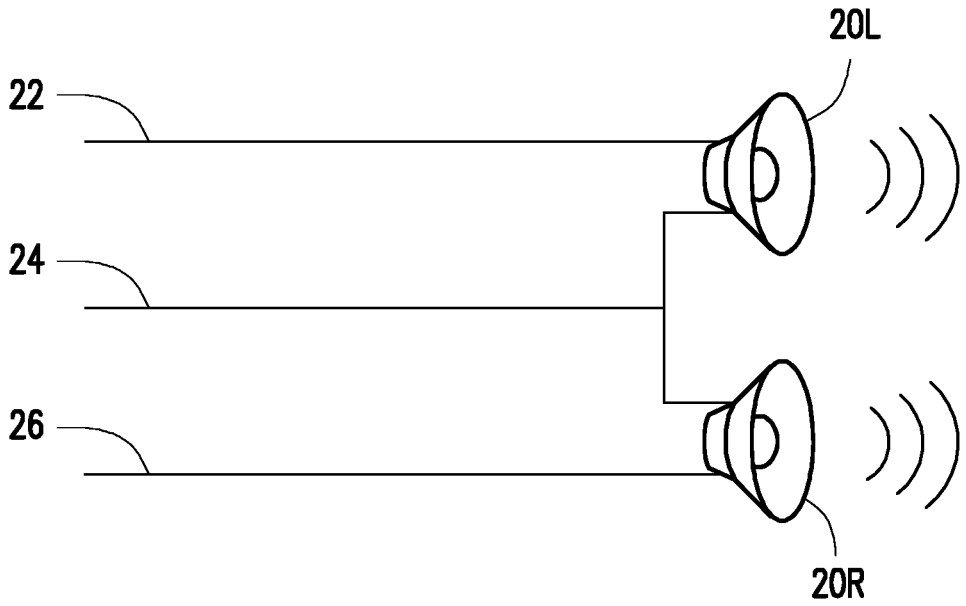
FIG. 1 is a schematic view of a stereo headphone structure with three terminals as to be driven in the invention, according to an embodiment of the present disclosure.

FIG. 1 is a schematic view of a stereo headphone structure with three terminals as to be driven in the invention, according to an embodiment of the present disclosure. Referring to FIG. 1, the headphone to be driven by the headphone driver of the present disclosure is, for example, a stereo headphone. For a stereo headphone, it includes a left-channel speaker 20L and a right-channel speaker 20R. Each of the speakers has a first terminal and a second terminal for receiving a driving signal, such that the diaphragm of the speaker vibrates according to the frequency and amplitude of the driving signal, thereby pushing the air to produce an actual sound.

In the condition that the structure of typical stereo headphone is not changed, the second terminals of the two speakers are connected as a common terminal, so the inputs of the two speakers are electrical driving signals as inputted from three terminals 22, 24, 26, wherein the terminal 22 and the terminal 26 corresponding to the two channels provide the electrical acoustic signals and are respectively connected to first terminals of the two speakers. The terminal 24 is a common terminal connected to a second terminal of the speaker. The terminal 24 provides a reference voltage terminal for the two speakers.

Since the above headphone structure is a common structure, and is mass-produced according to this structure, under the premise of not changing the structure of the headphone, the driving circuit to drive the headphone would be designed based on the headphone structure.

The driving method of the headphone may be designed differently with respect to different needs, and each has its own advantages and disadvantages. As described above, if the capacitor is used to exclude the DC current as seen in the conventional design, the phenomenon of pop noise would occur during the instant when the headphone is enabled in an example. Alternatively, if the operation voltage of the headphone driver is between a positive voltage and a negative voltage, the driver then needs to be further implemented with a circuit to produce negative voltage and then effectively increases the circuit cost.

The disclosure provides a driver for the headphone capable of effectively controlling the reference voltage, so that both the second terminals of the two speakers of the headphone can be stably set to the reference voltage.

Figure 2:
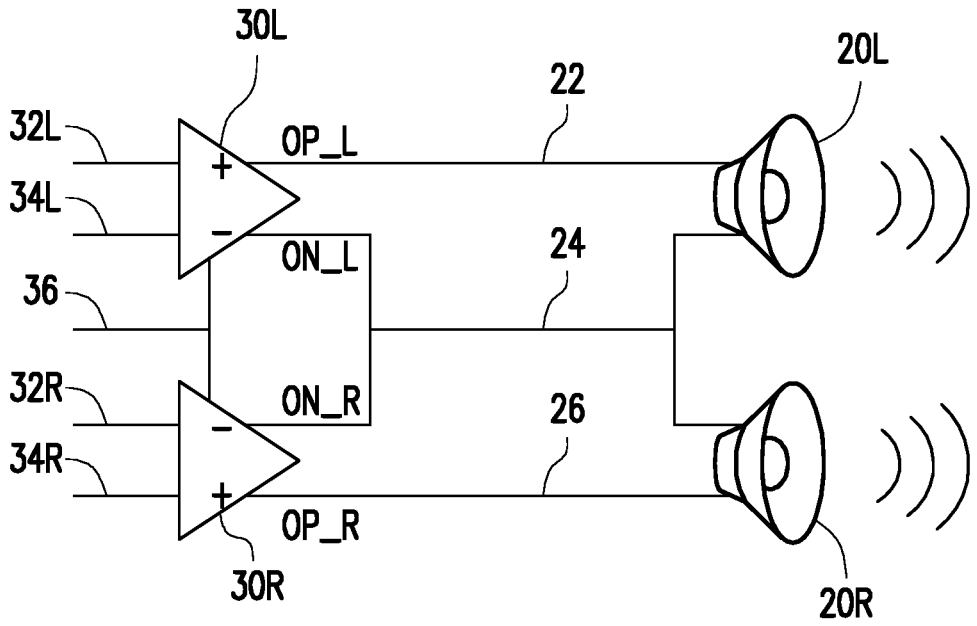
FIG. 2 is a schematic view of a headphone driving structure according to an embodiment of the present disclosure.

FIG. 2 is a schematic view of a headphone driving structure according to an embodiment of the present disclosure. Referring to FIG. 2, in one embodiment, the headphone driver of the present disclosure may be used to drive the first speaker 20L and the second speaker 20R of the headphone. The circuit of the headphone driver includes a first differential driver 30L and a second differential driver 30R. The first differential driver 30L has a first positive output terminal (OP_L) and a first negative output terminal (ON_L). The first positive output terminal (OP_L) through the terminal 22 of the headphone is connected to a first terminal of the first speaker 20L. The first negative output terminal (ON_L) is virtually shorted to a reference voltage through a first feedback circuit in the first differential driver 30L. Here, the circuit structure in the first differential driver 30L is to be described in FIG. 3 in better detail, such as the circuit formed from the operational amplifier 42. The first negative output terminal (ON_L) is fed back to an input terminal of the operational amplifier 42, so as to be virtually shorted to the reference voltage.

The reference voltage is input from a terminal 36. In one embodiment, the first differential driver 30L also receives an audio signal of one channel, which in an example is a differential AC electrical audio signal, through the terminal 32L and the terminal 34L. The electrical audio signal as input is processed by the first differential driver 30L and then is output to the first positive output terminal (OP_L) and the first negative output terminal (ON_L). The first positive output terminal (OP_L) and the first negative output terminal (ON_L) are respectively connected to a first terminal and a second terminal of the first speaker 20L through terminal 22 and terminal 24 of the headphone. In this manner, the second terminal of the first speaker 20L is connected to the terminal 24, and is virtually shorted to the reference voltage by the feedback circuit, in which the reference voltage is input through the terminal 36. As stated above, the mechanism being vertically shorted in the feedback circuit can be referring to the operational amplifier 42 in FIG. 3.

Figure 3:
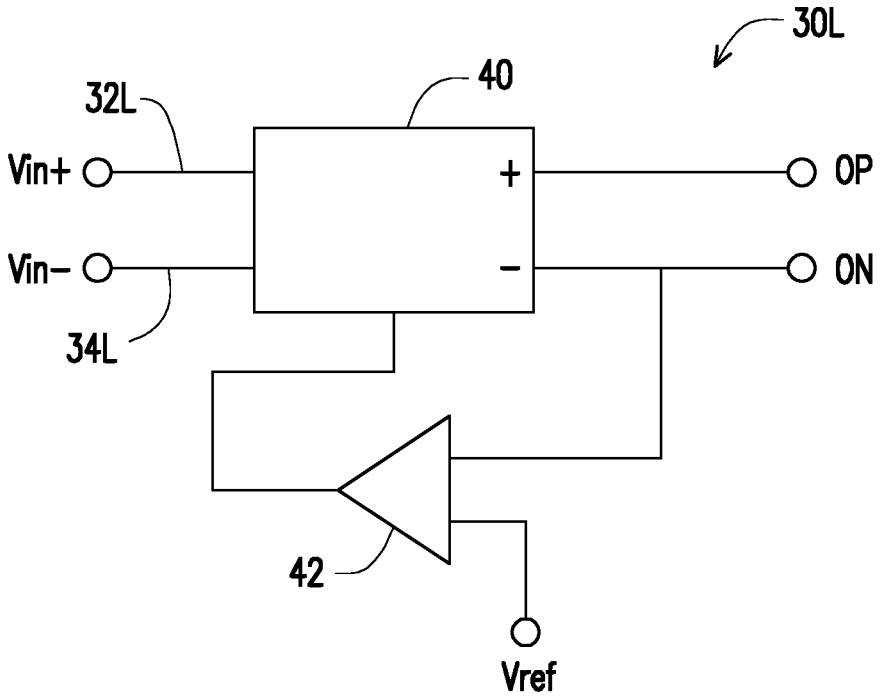
FIG. 3 is a circuit diagram of a differential driver in FIG. 2 according to an embodiment of the present disclosure.

For the second speaker 20R of the other channel, it is also driven by the second differential driver 30R. The second differential driver 30R has a second positive output terminal (OP_R) and a second negative output terminal (ON_R). The second positive output terminal (OP_R) is connected to a first terminal of the second speaker 20R through the terminal 26 of the headphone. The second negative output terminal (ON_R) is virtually shorted to the reference voltage through a second feedback circuit in the second differential driver 30R. As stated above, the internal circuit structure of the second differential driver 30R is described as shown in FIG. 3.

Similarly, the reference voltage is input from the terminal 36. In one embodiment, the second differential driver 30R also receives an audio signal of another channel, which in an example is a differential AC electrical audio signal, input from the terminal 32R and the terminal 34R. The input electrical audio signal is processed by the second differential driver 30R and then output to the second positive output terminal (OP_R) and the second negative output terminal (ON_R). The second positive output terminal (OP_R) and the second negative output terminal (ON_R) are respectively connected to the terminal 26 and the terminal 24 of the headphone. The terminal 26 and the terminal 24 are respectively connected to a first terminal and a second terminal of the second speaker 20R. In this manner, the second terminal of the second speaker 20R is connected to the common terminal 24 and is virtually shorted to the reference voltage through the feedback circuit (referring to FIG. 3). The reference voltage is input from the terminal 36.

In view of the connection relationship of the circuits, the first negative output terminal (ON_L) of the first differential driver 30L and the second negative output terminal (ON_R) of the second differential driver 30R are commonly connected to a common line corresponding to the terminal 24. The common line is further connected to second terminals of the first speaker 20L and the second speaker 20R.

The circuit structures of the first differential driver 30L and the second differential driver 30R may be the same, but the first differential driver 30L and the second differential driver 30R receive electrical signals of two channels, respectively. In this embodiment, the input ports of the first differential driver 30L and the second differential driver 30R are exemplified by a dual-terminal for receiving signal.

Taking the first differential driver 30L as an example, the internal circuit structure thereof is described below. FIG. 3 is a circuit diagram of a differential driver 30L, 30R in FIG. 2 according to an embodiment of the present disclosure. Referring to FIG. 3, the first differential driver 30L includes a fully differential amplifier 40 and an operational amplifier 42. In one embodiment, the input port of the fully differential amplifier 40 includes two terminals 32L, 34L for receiving input signals. The input signal is, for example, an AC signal between voltage Vin+ and voltage Vin−. The fully differential amplifier 40 provides a positive output terminal (OP) and a negative output terminal (ON).

The differential driver 30L and 30R further provides a feedback circuit to feed the negative output terminal (ON) back to the fully differential amplifier 40 through the operational amplifier 42. One input terminal of the operational amplifier 42 is connected to a reference voltage Vref. Another input terminal of the operational amplifier 42 is connected to the negative output terminal (ON) of the fully differential amplifier 40.

Based on the circuit characteristics of the negative feedback loop and the operational amplifier 42 with high gain, the two input terminals are virtually shorted, that is, the voltage at the negative output terminal (ON) is drawn to the reference voltage Vref due to the virtual short of the two input terminals. The reference voltage Vref in the circuit of FIG. 2 is provided by the terminal 36.

For the second differential driver 30R of the other channel, the circuit thereof is the same as that of the first differential driver 30L but the two terminals 32L, 34L for input, as shown in FIG. 2, are respectively changed to the two terminals 32R, 34R, and the negative output terminal (ON) serves as the second negative output terminal (ON_R), being virtually shorted to the same reference voltage Vref.

As the headphone driving circuit described above, the reference voltage may be controlled to a proper voltage level at stable state, such that the driving signals of the two channels may vary with respect to the reference voltage at stable state. The reference voltage in an example is the direct-current voltage level between two voltage levels of the signals, such as the reference voltage Vref between the voltage V+ and the voltage V− as to be shown in FIG. 4. The headphone is at an initial state while the headphone is connected and enabled at the instant time. Even in a case that the signal is not input yet, the driving circuit has already been activated. At this moment, the voltage levels at the positive output terminal (OP) and the negative output terminal (ON) in circuit operation are together biased to the reference voltage as the initial state. The voltage levels at the positive output terminal (OP) and the negative output terminal (ON) are substantially the same. In other words, no differential signal or just a small differential signal is output to the speaker, so the phenomenon of pop noise can be effectively reduced.

Figure 4:
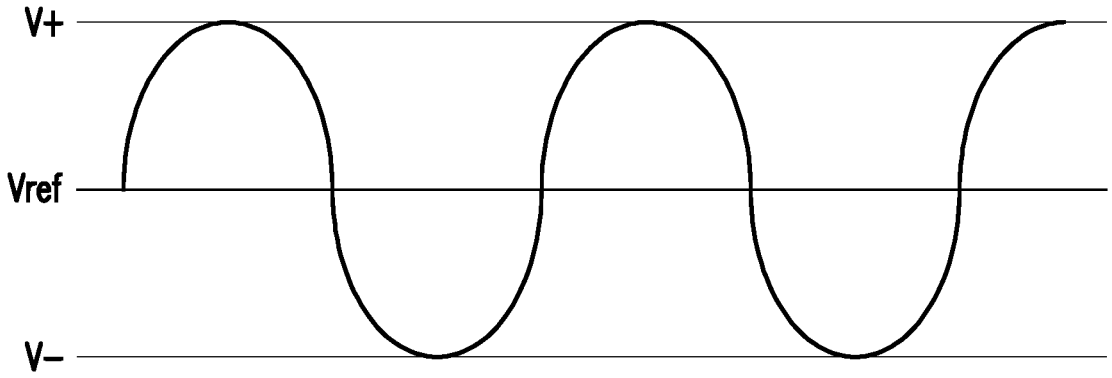
FIG. 4 is a schematic diagram of an AC electrical signal according to an embodiment of the present disclosure.

About the setting of the reference voltage, FIG. 4 is a schematic diagram of an AC electrical signal according to an embodiment of the present disclosure. Referring to FIG. 4, according to the form of the AC signal, the signal is alternating changing between the voltage V+ and the voltage V−. Therefore, the voltage level of the reference voltage Vref is set at a direct-current voltage level of an audio AC signal. In this manner, the signals of the two channels vary with respect to the stable reference voltage Vref.

Figure 5:
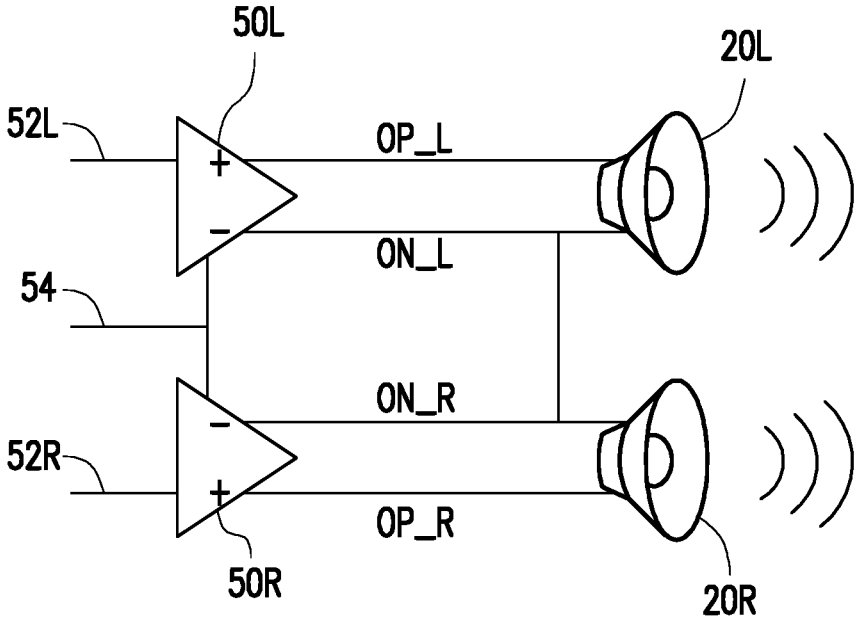
FIG. 5 is a schematic view of a headphone driving structure according to an embodiment of the present disclosure.

In addition, the input source of the differential driver may be a single-ended input terminal, but the driving mechanism is similar. FIG. 5 is a schematic view of a headphone driving structure according to an embodiment of the present disclosure.

Referring to FIG. 5, the circuit of the headphone driver includes a first differential driver 50L and a second differential driver 50R. The input ports of the first differential driver 50L and the second differential driver 50R are both a single-ended input terminal. That is, the input port of the first differential driver 50L is a single-ended input terminal 52L, and the input port of the second differential driver 50R is also a single-ended input terminal 52R. The output of the first differential driver 50L is still the first positive output terminal (OP_L) and the first negative output terminal (ON_L) for respectively connecting to a first terminal and a second terminal of the first speaker 20L, and then driving the first speaker 20L. The output of the second differential driver 50R is still the second positive output terminal (OP_R) and the second negative output terminal (ON_R), which are used to respectively connect to the first terminal and the second terminal of the second speaker 20R, so as to further drive the second speaker 20R. The reference voltage is input from a terminal 54 to the first differential driver 50L and the second differential driver 50R. Each of the first differential driver 50L and the second differential driver 50R includes the operational amplifier 42, 62 as shown in FIG. 3 or in FIG. 6 later. The reference voltage is received through a terminal of the operational amplifier. The first negative output terminal (ON_L) and the second negative output terminal (ON_R) are respectively fed back to another terminal of the operational amplifiers. Due to the property of the virtual short at the input terminals of the operational amplifier, the voltages of the first negative output terminal (ON_L) and the second negative output terminal (ON_R) are virtually shorted to the reference voltage, through the operational amplifiers respectively included in the first differential driver 50L and the second differential driver 50R. The voltages of the first negative output terminal (ON_L) and the second negative output terminal (ON_R) are maintained at the same reference voltage.

Figure 6:
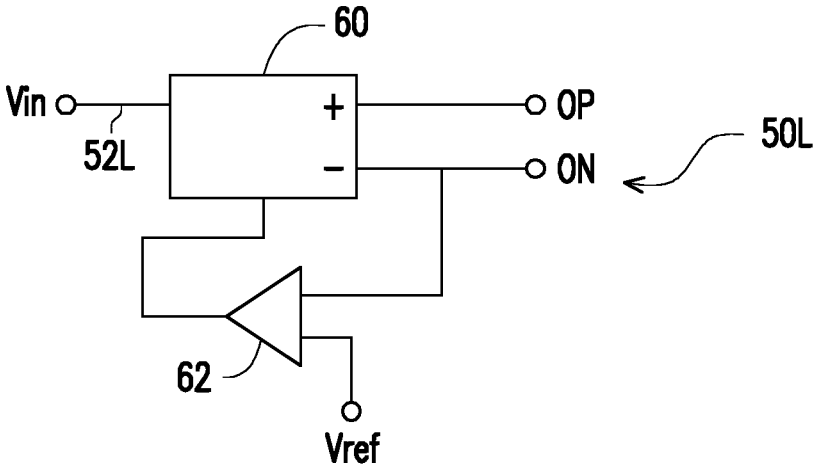
FIG. 6 is a drawing, schematically illustrating a differential driver in FIG. 5 according to an embodiment of the present disclosure.

FIG. 6 is a drawing, schematically illustrating a differential driver 52L, 52R in FIG. 5 according to an embodiment of the present disclosure. Referring to FIG. 6, taking the first differential driver 50L as an example, the circuit being similar to that described in FIG. 5 includes a fully differential amplifier 60 and an operational amplifier 62. The input port of the fully differential amplifier 60 is a single-ended input terminal 52L that receives an audio signal Vin. The driving mechanism of the differential driver 50L and the differential driver 50R is similar to that of the differential driver 30L and the differential driver 30R in FIG. 2 and will not be repeatedly described.

The headphone driving technology of the present disclosure utilizes an operational amplifier, so as to cause the second terminal of the speaker to be virtually shorted to a reference voltage. The driver can maintain the driving manner of the AC signal. Overall, the present disclosure may effectively eliminate the occurrence of pop-noise. In addition, the signal may still be the form of AC signal, and for example, the cost of circuit to produce negative voltage may be saved.

Although the disclosure has been disclosed by the above embodiments, the embodiments are not intended to limit the disclosure. It will be apparent to those skilled in the art that various modifications and variations can be made to the structure of the disclosure without departing from the scope or spirit of the disclosure. Therefore, the protecting range of the disclosure falls in the appended claims.

What is claimed is:

1. A headphone driver, for driving a first speaker and a second speaker, comprising:

a first differential driver, having a first positive output terminal and a first negative output terminal, the first positive output terminal connected to a first terminal of the first speaker, wherein the first negative output terminal is virtually shorted to a reference voltage through a first feedback circuit in the first differential driver; and a second differential driver, having a second positive output terminal and a second negative output terminal, the second positive output terminal connected to a first terminal of the second speaker, wherein the second negative output terminal is virtually shorted to the reference voltage through a second feedback circuit in the second differential driver, wherein the first negative output terminal and the second negative output terminal are connected to a common line and the common line is to be further connected to second terminals of the first speaker and the second speaker.

2. The headphone driver of claim 1, wherein the first differential driver comprises:

a fully differential amplifier, receiving an input signal and providing the first positive output terminal and the first negative output terminal; and an operational amplifier as the first feedback circuit, wherein a first input terminal of the operational amplifier is connected to the reference voltage, and a second input terminal of the operational amplifier is connected to the first negative output terminal, wherein an output terminal of the operational amplifier is fed back to a feedback signal input terminal of the fully differential amplifier.

3. The headphone driver of claim 1, wherein the second differential driver comprises:

a fully differential amplifier, receiving an input signal and providing the second positive output terminal and the second negative output terminal; and an operational amplifier as the second feedback circuit, wherein a first input terminal of the operational amplifier is connected to the reference voltage, and a second input terminal of the operational amplifier is connected to the second negative output terminal, wherein an output terminal of the operational amplifier is fed back to a feedback signal input terminal of the fully differential amplifier.

4. The headphone driver of claim 1, wherein an input port of the first differential driver is differential input terminals.

5. The headphone driver of claim 1, wherein an input port of the first differential driver is a single-ended input terminal.

6. The headphone driver of claim 1, wherein an input port of the second differential driver is differential input terminals.

7. The headphone driver of claim 1, wherein an input port of the second differential driver is a single-ended input terminal.

8. The headphone driver of claim 1, wherein the reference voltage is set at a direct-current voltage level of an electrical audio alternating current (AC) signal.

9. A headphone driving method, for driving a first speaker and a second speaker, comprising:

using a first differential driver for receiving a first input signal and outputting a first driving signal through first differential output terminals including a first positive output terminal and a first negative output terminal, the first positive output terminal connected to a first terminal of the first speaker;

virtually shorting the first negative output terminal to a reference voltage through a first feedback circuit in the first differential driver;

using a second differential driver for receiving a second input signal and outputting a second driving signal through second differential output terminals including a second positive output terminal and a second negative output terminal, the second positive output terminal connected to a first terminal of the second speaker;

virtually shorting the second negative output terminal to the reference voltage through a second feedback circuit in the second differential driver; and connecting the first negative output terminal and the second negative output terminal to a common line, wherein the common line is to be further connected to second terminals of the first speaker and the second speaker.

10. The headphone driving method of claim 9, wherein the first differential driver used in the method comprises:

a fully differential amplifier, receiving the first input signal and providing the first positive output terminal and the first negative output terminal; and an operational amplifier as the first feedback circuit, wherein a first input terminal of the operational amplifier is connected to the reference voltage, and a second input terminal of the operational amplifier is connected to the first negative output terminal, wherein an output terminal of the operational amplifier is fed back to a feedback signal input terminal of the fully differential amplifier.

11. The headphone driving method of claim 9, wherein the second differential driver used in the method comprises:

a fully differential amplifier, receiving the second input signal and providing the second positive output terminal and the second negative output terminal; and an operational amplifier as the second feedback circuit, wherein a first input terminal of the operational amplifier is connected to the reference voltage, and a second input terminal of the operational amplifier is connected to the second negative output terminal, wherein an output terminal of the operational amplifier is fed back to a feedback signal input terminal of the fully differential amplifier.

12. The headphone driving method of claim 9, wherein an input port of the first differential driver is differential input terminals for receiving the first input signal.

13. The headphone driving method of claim 9, wherein an input port of the first differential driver is a single-ended input terminal for receiving the first input signal.

14. The headphone driving method of claim 9, wherein an input port of the second differential driver is differential input terminals for receiving the second input signal.

15. The headphone driving method of claim 9, wherein an input port of the second differential driver is a single-ended input terminal for receiving the second input signal.

16. The headphone driving method of claim 9, wherein the reference voltage is set at a direct-current voltage level of an electrical audio alternating current (AC) signal.

17. A headphone driver for driving a speaker, comprising:

a differential driver, having a positive output terminal and a negative output terminal, the positive output terminal connected to a first terminal of the speaker, wherein the negative output terminal is virtually shorted to a reference voltage through a feedback circuit in the differential driver, wherein the negative output terminal of the differential driver is connected to a line, the line is to be further connected to a second terminal of the speaker.

18. The headphone driver of claim 17, wherein the differential driver comprises:

a fully differential amplifier, receiving an input signal and providing the positive output terminal and the negative output terminal; and an operational amplifier serving as the feedback circuit, wherein a first input terminal of the operational amplifier is connected to the reference voltage, and a second input terminal of the operational amplifier is connected to the first negative output terminal, wherein an output terminal of the operational amplifier is fed back to a feedback signal input terminal of the fully differential amplifier.

* * * * *